US005467546A

United States Patent [19]

Kovalak, Jr.

[11] Patent Number: 5,467,546

[45] Date of Patent: Nov. 21, 1995

[54] TENSIONED FABRIC SIGN

[75] Inventor: Judson L. Kovalak, Jr., Rockford, Mich.

[73] Assignee: SignComp, Inc., Comstock Park, Mich.

[21] Appl. No.: 63,245

[22] Filed: May 18, 1993

Related U.S. Application Data

[63] Continuation of Ser. No. 690,055, Apr. 23, 1991, abandoned.

[51] Int. Cl.[6] ..... G09F 17/00

[52] U.S. Cl. ..... 40/603; 160/378

[58] Field of Search ..... 40/603, 549, 156, 40/604; 160/378, 328, 392, 395, 380; 38/102.91

[56] References Cited

U.S. PATENT DOCUMENTS

| | | | |
|---|---|---|---|
| 2,335,361 | 11/1943 | Schiller | 160/395 |
| 3,058,279 | 10/1962 | Metcalfe | 160/378 |
| 4,041,861 | 8/1977 | Alter . | |
| 4,265,039 | 5/1981 | Brooks . | |
| 4,317,302 | 3/1982 | Von De Linde . | |
| 4,452,000 | 6/1984 | Gandy | 40/603 |
| 4,452,000 | 6/1984 | Gandy | 40/603 |
| 4,516,343 | 5/1985 | Stilling . | |
| 4,542,605 | 9/1985 | Gandy . | |
| 4,547,987 | 10/1985 | Stilling . | |
| 4,674,214 | 6/1987 | Gandy et al. | 40/603 |
| 4,674,214 | 6/1987 | Gandy | 40/603 |
| 4,692,847 | 9/1987 | Gandy . | |
| 4,937,961 | 7/1990 | Grandy et al. | 160/378 |
| 4,955,928 | 9/1990 | Tanner | 40/603 |
| 5,033,216 | 7/1991 | Grandy et al. | 40/603 |
| 5,046,546 | 9/1991 | Benedyk et al. | 160/392 |

OTHER PUBLICATIONS

Brochure entitled "Total, practicel Innovations in Sign Cabinets and Frames" by Sun Plastics.

Flyer entitled "Frameless Retrofit Vinyl Tensioning Face Frame," by Signpro Systems.

Flyer entitled "Clip Tensioning System" by Signtech.

*Primary Examiner*—Brian K. Green

*Attorney, Agent, or Firm*—Warner Norcross & Judd

[57] ABSTRACT

A tensioned fabric sign having a peripheral frame and a sheet of indicia bearing fabric stretched thereon. The margins of the fabric are retained in longitudinal frame recesses by tension clips having teeth in ratcheting engagement with closely spaced grooves formed within the frame recess. The clips are configured with a fabric grasping recess along the extent of the clip innermost of the recess and with teeth along the extent of the clip outermost of the recess. Tension in the fabric tightens the grasp of the clip on the fabric margin and urges the clip teeth into engagement with the frame recess grooves. An intermediate frame member having a pair of recesses for retaining the margins of two sheets of sign fabric is also disclosed.

26 Claims, 4 Drawing Sheets

TENSIONED FABRIC SIGN

This is a continuation of application Ser. No. 07/690,055, filed Apr. 23, 1991 (now abandoned).

BACKGROUND OF THE INVENTION

1. Field of the Invention

The present invention relates to signs, and, more particularly, to an apparatus for tensioning a fabric sign on a frame.

2. Description of the Related Art

It is known in the art to provide a sign that is constructed of a sheet of fabric stretched or tensioned over a peripheral frame. The outer surface of the fabric is marked with indicia, and there is often illumination means behind the fabric within the frame to provide an illuminated sign.

Often, tensioned fabric signs are constructed with a peripheral recess in the frame members and retainer devices for grasping outer edge portions of the fabric within the recesses. The grasping devices cooperate with tensioning devices which tightly stretch the fabric over the frame. These tensioning devices of the prior art include threaded screws inserted in grooved slots or tapped holes which cooperate with the fabric retainer devices. Signs constructed in this manner are disadvantageously complicated to assemble and disassemble due to the need for the screws, the grooved or tapped recesses for receiving the screws, and the time and energy required to tighten and balance each of the screws.

Thus, there is an unmet need for a tensioned fabric sign of simplified construction that is readily and easily assembled, disassembled, and evenly tensioned and adjusted.

SUMMARY OF THE INVENTION

The present invention satisfies the above mentioned need by providing a tensioned fabric sign construction in which the marginal portions of the sign fabric are retained and tensioned in peripheral frame recesses by retaining devices held within the frame recesses without the need for screws or other additional tensioning devices. The retaining devices include tension clips which grasp the marginal portions of the fabric and retain these margins within the frame recesses in such a manner that the tension in the fabric is utilized to enhance the retaining strength of the tension clips in cooperation with the frame recesses.

According to the invention, there is a sign frame including frame members joined together to form a peripheral frame surrounding at least one opening. Each frame member includes a longitudinal recess. One interior wall of the recess is formed with a plurality of longitudinal, spaced apart grooves. At intervals along the margin of the sign fabric, the fabric is grasped by tension clips. Each clip includes a tension clip body having tabs formed at the longitudinally spaced apart ends of the clip body. These tabs are formed with teeth adapted to engage the grooves of the frame recess wall.

Each tension clip body is further formed with a longitudinal recess disposed along an edge of the tension clip body generally opposite the tabs. At spaced apart locations along the margin of the fabric, the fabric margin is wrapped around a spline. The fabric margin and spline are inserted into the recess of the tension clip body. The tension clip body, along with the fabric margin and spline held by the clip body, is inserted into the frame recess with the edge of the clip body having the recess entering the frame recess first. The clip body is pressed into the frame recess until the desired degree of fabric tension is reached. The teeth on the tabs of the clip body engage the grooves of the frame recess wall. The configuration of the various parts is such that the tension of the fabric is used to increase the grasping force on the fabric margin. The fabric tension also induces a rotational moment on the clip body which urges the teeth of the tension clip body against the grooves of the frame recess. In this manner, the fabric is tensioned on the frame with the fabric margins retained within the frame recesses. Only a minimum of parts are used and there is no need for screws.

The sign of the invention is easily disassembled by the provision of a depression in the tension clip body for engaging a pry bar. The end of a pry bar, such as a screwdriver, is inserted in this recess and used to disengage the tension clip teeth from the grooves of the frame recess.

In a further aspect of the invention, there is provided a frame member having a pair of spaced apart, parallel recesses in which the margins of two adjacent sign fabrics are retained. This frame member is advantageously used across an intermediate portion of the peripheral frame to divide the sign into a plurality of sign sections.

These and other objects, advantages, and features of the present invention will be more fully understood and appreciated by reference to the written specification and appended drawings.

DESCRIPTION OF THE PREFERRED EMBODIMENT

As used herein, as well as in the claims, terms such as "forward" "rearward" "inward" and "outward" are used as an expedient to describe and claim the invention. These terms refer to directions relative to a normally assembled and displayed tensioned fabric sign. For example, the viewable surface of the sign fabric is normally directed forwardly, and the outer perimeter of the sign is directed outwardly. The direction toward the center of the sign along the surface of the sign fabric is inward. However, the use of such terms in this manner is not to be taken as limiting the scope of the invention to any particular directional orientation.

Figure 1:
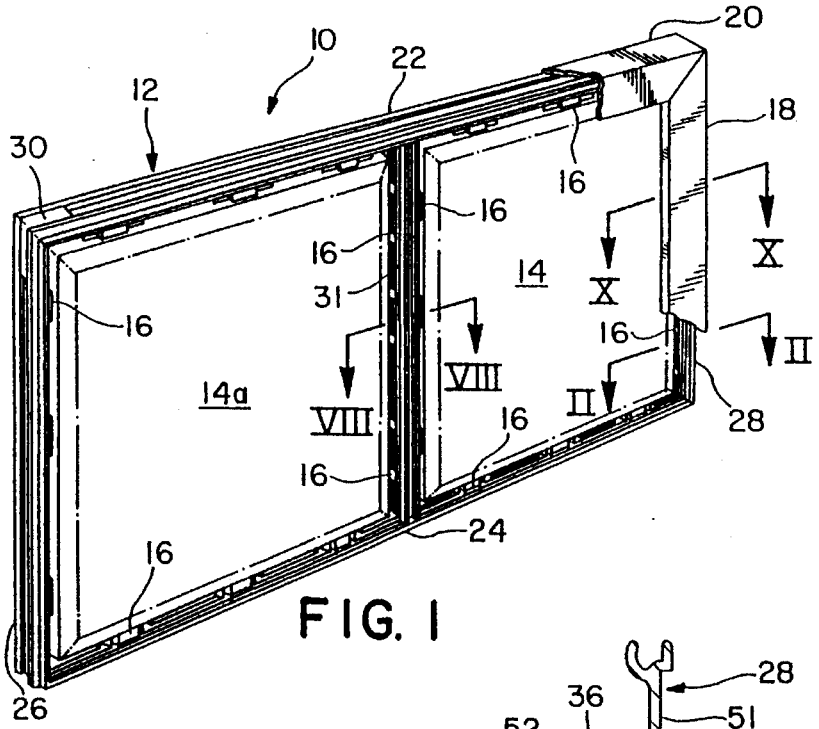
FIG. 1 is a front perspective view of a tensioned fabric sign, with parts broken away, according to the principles of the invention.

By way of disclosing a preferred embodiment, and not by way of limitation, there is shown in FIG. 1 a tensioned fabric sign 10 which includes in its general organization a peripheral frame 12, two sheets of fabric 14, 14*a*, several tension clips 16, and frame cover members 18, 20. The frame 12 includes spaced apart, parallel top and bottom frame members 22, 24, and spaced apart, parallel side frame members 26, 28. The adjacent ends of the frame members are joined together in a known manner by L-shaped corner connectors 30 and further held together by, for example, welding or screws (not shown).

Spanning between approximately the midsections of the top and bottom frame members 22, 24 there is an intermediate frame member 31 which divides the sign into two portions. It should be understood that the intermediate frame member and the division of the sign are optional. Signs may also be constructed according to the invention with a single sheet of fabric tensioned over a single opening in a peripheral frame.

As is well known in the art, the sheets of fabric 14 are normally printed or silk-screened with indicia. The fabric may be made of a vinyl polymeric material reinforced with a mesh of fibers. A translucent material may be used for the fabric, and lighting devices such as fluorescent tubes may be installed within the sign as is also well known.

The number of tension clips 16 will vary according to the size of the sign. It has been found that a center-to-center spacing of from 6 inches to 8 inches between clips is adequate.

Figure 2:
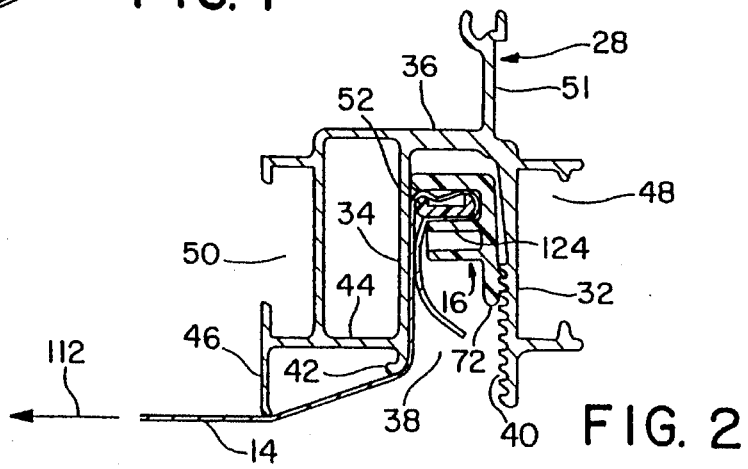
FIG. 2 is a sectional view, taken as indicated by the line II—II of FIG. 1.

Referring to FIG. 2, the configuration of the frame members may be seen. Side frame member 28 is illustrated, the other peripheral frame members 22, 24 and 26 having a similar configuration. Frame member 28 is advantageously formed in a known manner as an extruded, elongated profile of aluminum. There is an outer wall 32 disposed generally perpendicularly to the plane of the sign, an inner wall 34 inwardly spaced apart from outer wall 32 and generally parallel thereto, and a rear wall 36 disposed generally parallel to the plane of the sign and spanning across the rearmost extents of the inner and outer walls 32, 34.

Together, the outer wall 32, inner wall 34, and rear wall 36 of the frame member cooperate to form a longitudinal recess 38 running the length of the peripheral frame member 28. The exterior opening of the recess 38 is oriented generally forwardly. The inner surface of the outer wall 32 is formed with a plurality of longitudinal, parallel, closely spaced grooves 40. The forward edge of the inner wall 34 is formed with an arcuate lip 42. A front wall 44 extends inwardly from the inner wall 34 just rearwardly of the lip 42. On the innermost extent of the front wall 44 there is an outwardly extending flange 46. Slotted recesses 48, 50 are formed along the outer and inner sides of the frame member. These recesses are adapted to receive corner connectors such as an outer corner connector 30 (FIG. 1 in recess 48 and an inner corner connector (not shown) in recess 50. There is a rearwardly extending flange 51 for use in attaching a cover member as more fully described below.

The marginal portion of the sheet of fabric 14 extends from the inner area of the sign over flange 46 where it bends rearwardly. The fabric further extends over lip 42 and thereafter rearwardly into the recess where it is retained under tension by the cooperation of the fabric 14, the clip 16, spline 52, recess 38, and grooves 40.

Figure 3:
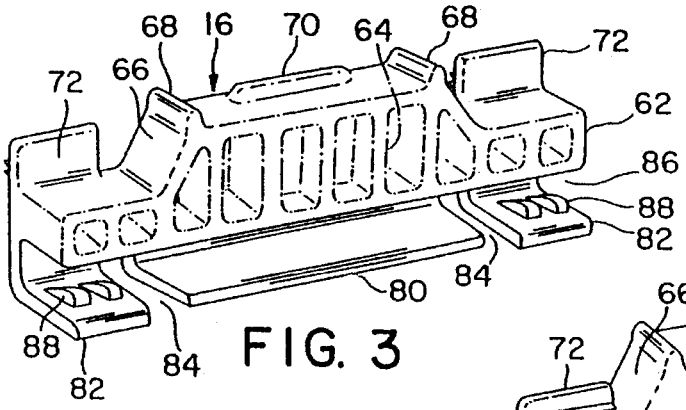
FIG. 3 is a rear perspective view of the tension clip according to the invention.
Figure 4:
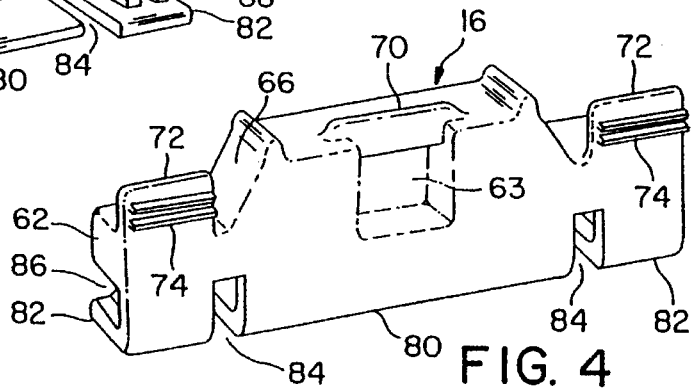
FIG. 4 is a front perspective view of the tension clip of FIG. 3.

Details of the construction of the tension clip 16 are shown in FIGS. 3 and 4. The clips are advantageously formed as a unitary piece of a strong, resiliently flexible, yet relatively stiff material. Each clip is formed as a generally longitudinally elongated body 62. The body 62 is generally hollow to save material and is provided with stiffening ribs 64 as seen from the inner side of the clip in FIG. 3. There is a raised central portion 66 of the body, and there are raised ridges 68 at each end of the central portion and a raised ridge 70 longitudinally along the midsection of the central portion.

At each end of the clip body 62, there is formed a forwardly extending tab 72. The outer surface of each tab 72 is formed with a spaced apart, longitudinally parallel pair of teeth 74. The teeth are formed at substantially the same spacing as the grooves 40 of the frame members and are adapted to engage the grooves and retain the clip 16 within the frame recess 38. Along the rearward extent of the clip body 62 are formed three lips including a central lip 80 and two end lips 82. Each of the lips 80, 82 extends rearwardly from the rear, outer extent of the clip body, then bends inwardly to be generally parallel and spaced apart from the rear surface of the clip body 62. In this manner, a longitudinal clip recess 86 is formed between the lips 80, 82 and the rearward surface of the clip body 62.

There are gaps 84 formed between each of the end lips 82 and the central lip 80. The end lips 82 are of approximately the same longitudinal width as the tabs 72. A pair of detents 88 is formed on each of the end lips 82 extending outwardly into the clip recess 86. The outer surface of the clip body 62 is formed with a depression 63 disposed generally adjacent to the central ridge 70.

It is essential that the clips be made of a material that is sufficiently strong to resist the shear forces placed on the teeth 74, yet which is resiliently flexible enough to allow the tabs 72 to flex and allow the teeth to ratchet past the grooves 40 of the frame. In this preferred embodiment, the clips are made of an acetal plastic material sold by Du Pont under the trademark DELRIN, grade 507. An alternate material is BASF number N2320. These materials are further to able to resist the elevated temperatures caused by exposure of the sign to the sun.

Figures 13A, 13B:
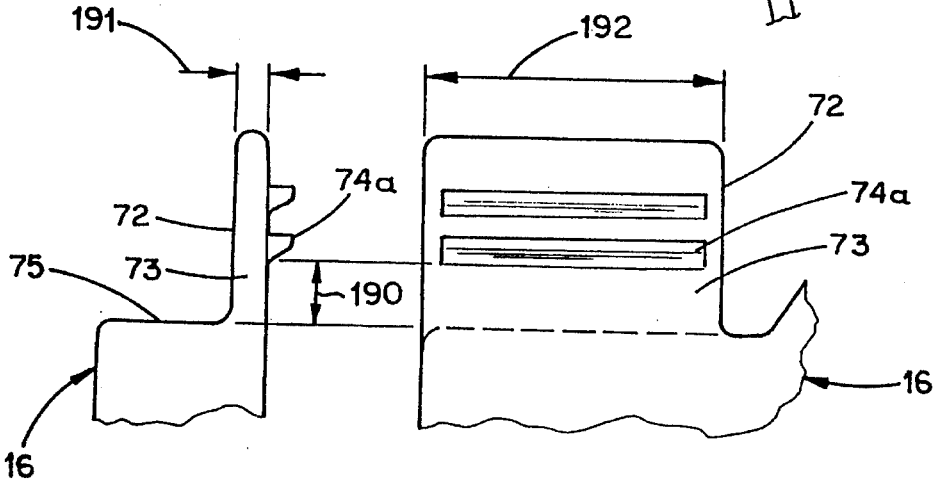
FIGS. 13*a* and 13*b* are enlarged, fragmentary end and rear views respectively, of the clip tabs.

Furthermore, the tabs 72 must be approximately dimensioned to allow them to flex sufficiently without breaking. With the aforementioned DELRIN material, and as shown in FIGS. 13*a* and 13*b*, the tabs 72 will function properly with a tab throat 73 height, indicated by dimension 190, of 0.075 inch, a tab thickness, indicated by dimension 191, of 0.070 inch, and a tab width, indicated by dimension 192, of 0.480 inch.

Figure 5:
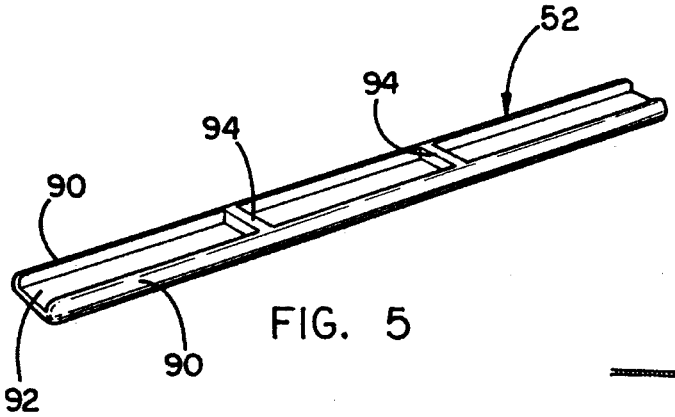
FIG. 5 is a perspective view of the spline according to the invention.

FIG. 5 shows details of the spline 52. The spline 52, also preferably formed of a molded polymeric material such as DELRIN, is a generally flat, elongated member having a width approximately equal to the width of the clip recess 86 (FIG. 3). Preferably, the spline is longitudinally somewhat longer that the tension clip to allow for adjustment of the position of the spline and fabric in the clip recess. The long edges of the spline have rearwardly extending lips 90 which define a trough 92 which acts in cooperation with the detents 88. A pair of spaced apart transverse ribs 94 is disposed across the trough 92. When the spline 52 is assembled into the tension clip 16, the ribs 94 cooperate with the detents 88 of the tension clip to prevent the spline from sliding longitudinally out of alignment with the tension clip.

The assembly of the sign according to the invention will now be described with reference to FIGS. 1, 6, 7 and 12. First, a peripheral frame 12 is assembled in a known manner with frame members joined end to end such as shown in FIG. 1. If desired, the central opening defined by the peripheral frame may be divided by the use of an intermediate frame member 31.

The sheet of sign fabric 14 is then cut to a shape and size somewhat larger than the opening defined by the frame. This may be done by spreading out the fabric and drawing a line on the fabric corresponding to the frame outer perimeter. The fabric is trimmed along a lines approximately one to one and one-half inch outside the frame perimeter line. Each corner of the fabric is notched by cutting away an approximately one and one-half to two inch square of material.

Figure 6:
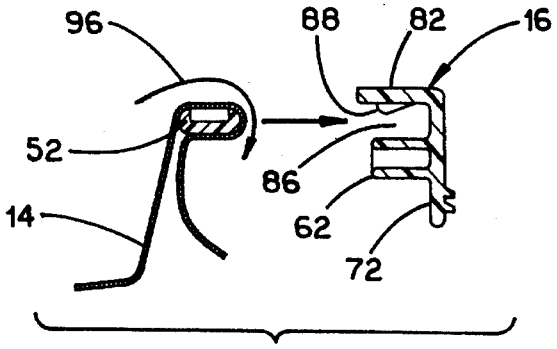
FIG. 6 is an end sectional view illustrating the assembly of the sign fabric margin, spline, and tension clip.

Next, as shown in FIG. 6, at spaced locations along the margin of the fabric, the margin of the fabric is wrapped around a spline 52. The direction of wrapping, as indicated by arrow 96, is first around the inner edge of the spline, across the rearward trough side of the spline then around the outer edge of the spline and back across the forward flat side.

Figure 7:
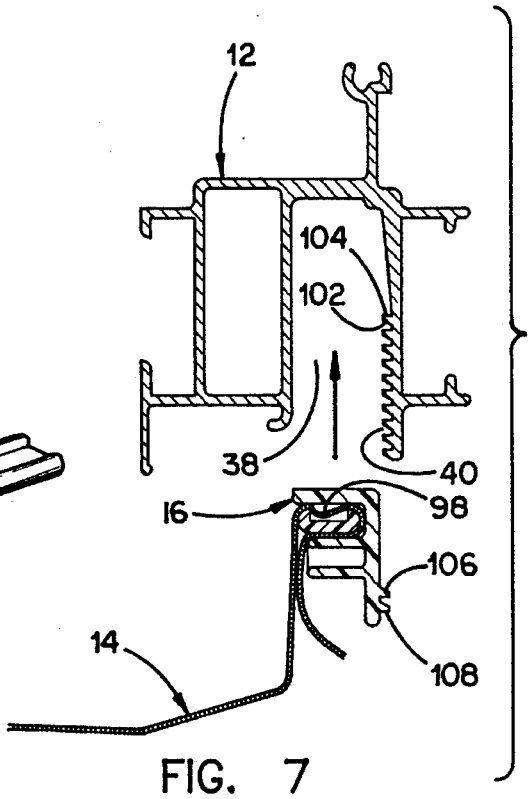
FIG. 7 is a sectional view similar to FIG. 2 but illustrating the insertion of the tension clip and fabric margin into a frame member.

Then, the spline 52 and its associated portion of the fabric margin are inserted into the clip recess 86. The end lips 82 are able to resilient flex such that the detents 88 snap into place in the trough. As shown in FIG. 7, this snapping action of the detents serves to deform a portion of the fabric margin into the trough of the spline as indicated at 98. In this manner, the fabric margin is grasped by the tension clip 16 and assembly with the frame is facilitated.

Still referring to FIG. 7, the tension clip 16 with the associated spline and marginal portion of the fabric 14 are then inserted at the appropriate location into the recess 38 of a frame member of the frame 12. The width of the recess of 38 is slightly larger than the width of the tension clip 16. The grooves 40 are formed with a plurality of closely spaced and alternating ramping surfaces 102 and perpendicular surfaces 104. Similarly, the teeth of the tension clip 16 are formed with corresponding closely spaced and alternating ramping surfaces 106 and perpendicular surfaces 108. This configuration of the grooves and teeth produces a ratchet effect which enable easy insertion of the clip but which resists withdrawal of the clip when under tension by the fabric.

Figure 12:
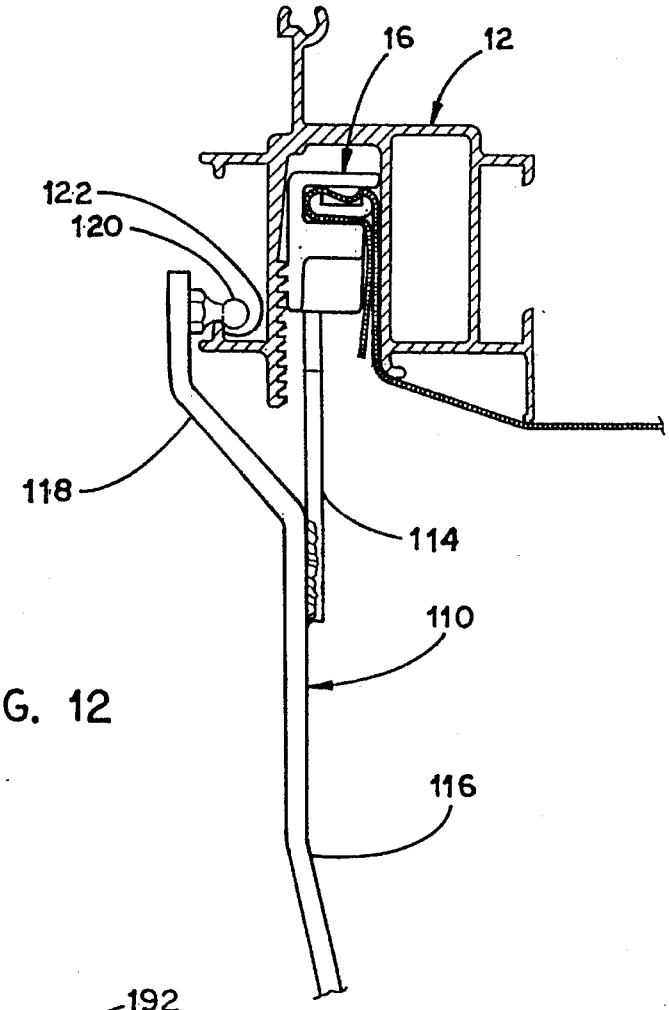
FIG. 12 is a sectional view illustrating the assembly of the sign with the use of a lever.

As shown in FIG. 12, the clip 16 may be inserted into the recess of the frame 12 with the aid of a tool 110. The tool is in the form of a lever and has a bifurcated insertion arm 114, a handle 116, and a fulcrum arm 118 rearwardly offset from the insertion arm 114. At the distal end of the fulcrum arm 118 there is a protrusion 120. In use, the protrusion 120 is hooked over an appropriate flange 122 or other outwardly extending protrusion of the frame. The end of the insertion arm 114 is brought into contact with the forward surface of the tension clip 16. The handle 116 is pulled or pushed in or out of the plane of the drawing, thus pressing the tension clip and fabric margin into the frame recess until the desired degree of fabric tension is reached.

Although a tool such as a lever tool 110 may be employed to develop a high degree of tension in the sign fabric, other type of tools may also be used. For example, the tension clip may be tapped in with a mallet directly, or with a mallet used on a bar or rod Contacting the tension clip. For a low degree of tension, the tension clip may be pushed in manually. Whatever method of inserting the tension is employed, it may be seen that the ratcheting cooperation of the clip teeth with the frame recess grooves allows for fine adjustment of the depth of insertion of the tension clip into the recess and, consequently, the degree of tension in the fabric. In this manner, the several tension clips used around the perimeter of the sign may be individually finely adjusted to produce an even and balanced tension in the sign fabric and to avoid any distortion of the indicia borne on the sign fabric.

Referring now to FIG. 2, it may be seen that the tension of the fabric as indicated by arrow 112 is utilized to enhance the grasping force applied to the fabric margin and further to enhance the engagement of the tension clip teeth with the frame recess grooves. As the tension clip is progressive more deeply inserted into the recess 38, tension is developed in the sign fabric 14 as indicated by arrow 112. This tension tends to pull outwardly on the inner edge of the spline 52, thereby pinching the fabric margin between the spline and the tension clip body in the area indicated by reference numeral 124. The pinch point thus created grasps the fabric margin and prevents its withdrawal from the frame. The more tension there is in the fabric, the more tightly the pinch point grasps the fabric.

Although FIG. 2 shows the tension clip 116 inserted substantially all the way to the rear of the recess 38, it should be understood that it is possible that proper tensioning of the fabric may be attained with a lesser depth of insertion of the tension clip. The teeth of the tension clip are adapted to engage the grooves of the frame recess at any of several closely spaced locations along the series of grooves.

The pulling of the inner edge of the spline 52 due to the tension in the fabric 14 further tends to rotate the tension clip 16 in the frame recess 38 about a longitudinal axis. This rotation or twisting force urges the tabs 72 of the tension clip outwardly, thereby pressing the teeth on the tabs in locking engagement with the grooves 40 of the frame recess. The more tension developed in the fabric, the more force applied to the engagement of the teeth and grooves.

Figure 11:
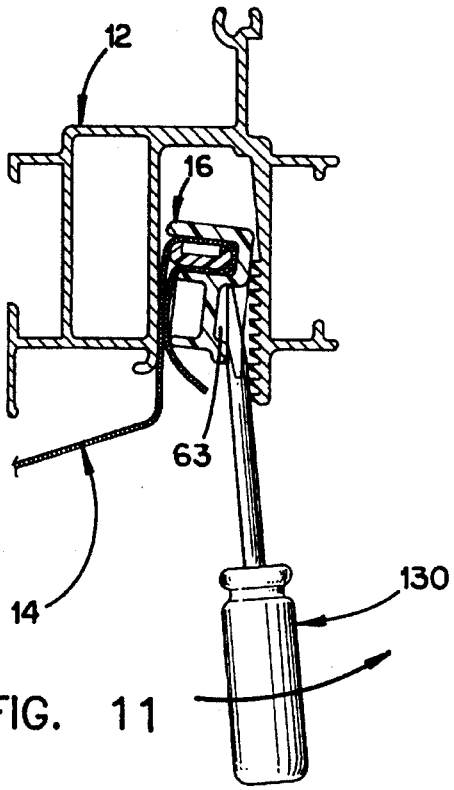
FIG. 11 is a sectional view through a frame member and tension clip illustrating the disassembly of the sign.

FIG. 11 illustrates the disassembly or loosening of the sign according to the invention. The end of a pry bar such as a screwdriver 130 is inserted into the frame recess between the recess grooves and the tension clip body and is directed into the depression 63 in the outer surface of the tension clip body. The handle end of the screwdriver is moved outwardly, and the tip end of the screwdriver pushes or rotates the tension clip inwardly so that the teeth on the tension clip (not shown) disengage from the frame recess grooves. The tension clip and fabric margin may then be pulled outwardly for complete removal from the frame recess or for easing of the fabric tension.

Figure 10:
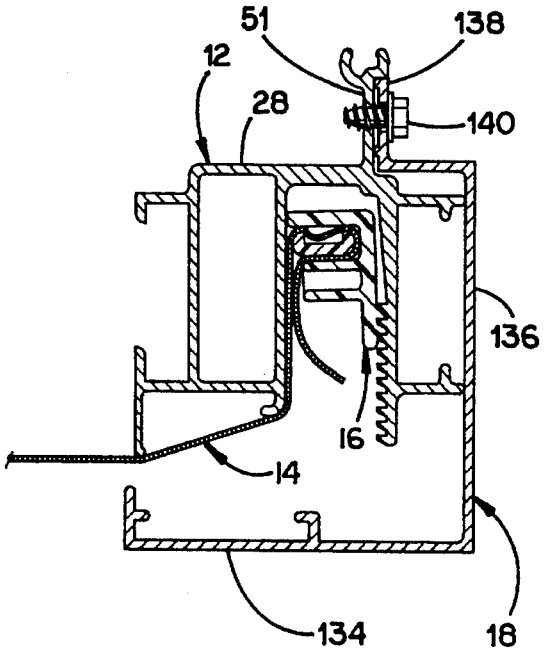
FIG. 10 is a sectional view taken along the line X—X of FIG. 1.

FIG. 10 shows the details of the use of a cover member 18 in conjunction with the frame 12 to present a neat and finished appearance for the sign. The cover member, also advantageously made as an aluminum extrusion, is configured generally as an elongated member having an L-shaped cross section. A forward leg 134 of the cover member extends across and forwardly of the frame to cover the sign fabric margin, frame recess and tension clip 16 from view. The cover member outer leg 136 extends rearwardly from the forward leg in perpendicularly offset relation thereto to cover the outer portions of the frame. An inwardly offset cover member flange 138 is disposed rearwardly of the frame and is attached to the flange 51 of the frame member 28 by a sheet metal screw 140 or other suitable fastening means. As shown in FIG. 1, the ends of the cover members such as cover members 18 and 20 are mitered. In this manner the unsightly aspects of the frame and fabric margins are covered from view.

Figure 8:
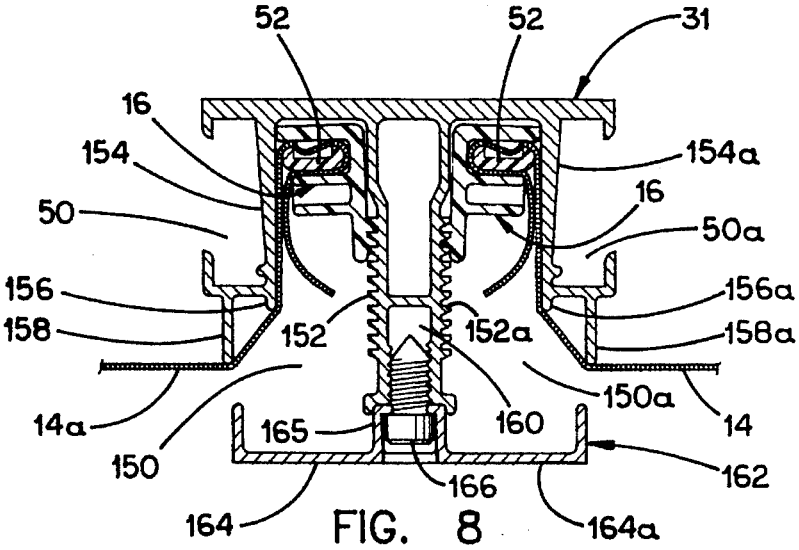
FIG. 8 is a sectional view taken generally along the line VIII—VIII of FIG. 1 showing an intermediate frame member according to the invention and also showing a cover member.

FIG. 8 shows the structural details of the intermediate frame member 31 which is used to divide the opening defined by the peripheral frame 12 into two or more smaller openings, each of the smaller openings being provided with its own sheet of indicia-bearing sign fabric. The intermediate frame member 31 is generally symmetrical about a longitudinal plane, having a pair of recesses 150, 150*a* disposed to either outwardly disposed side of the frame member. In a manner similar to the peripheral members of the frame, such as frame member 28, the recesses of the intermediate frame member are each defined by a grooved inner wall 152, 152*a* and an outer wall 154, 154*a*. On each outer side of the intermediate frame member there is a recess 50, 50*a* adapted for engagement with a corner connector, in a manner similar to the recess 48 and 50 described above with respect to FIG. 2.

Disposed outwardly of each recess 150, 150*a* of the intermediate frame member 31 and extending forwardly therefrom there are lips 156, 156*a* and flanges 158, 158*a* which serve to direct the bending of the margins sign fabric inwardly and rearwardly into the recesses 150, 150*a*. Tension clips 16 with 52 grasp, retain, and tension the sheets of fabric 14, 14*a* in the same manner as described above.

Still referring to FIG. 8, the inner walls 152, 152*a* of the intermediate frame member are spaced apart from each other so that a forwardly opening, longitudinal slot 160 is formed between them. An intermediate cover member 162 is placed longitudinally along the intermediate frame member to hide the recesses 150, 150*a* and fabric margins from view. The intermediate cover member 162 is generally in the form of a strip having a pair of flanged arms 164, 164*a* extending outwardly from the centerline of the member and a protrusion 165 extending rearwardly of the centerline of the member. The protrusion 165 engages the opening of the slot 160 to properly position and align the cover member with the frame member. The cover member 162 is fixed to the frame member 31 by screw 166 passing through the cover member into the slot or by other suitable means. The protrusion 165 forms a recess which receives the head of the screw 166.

Figure 9:
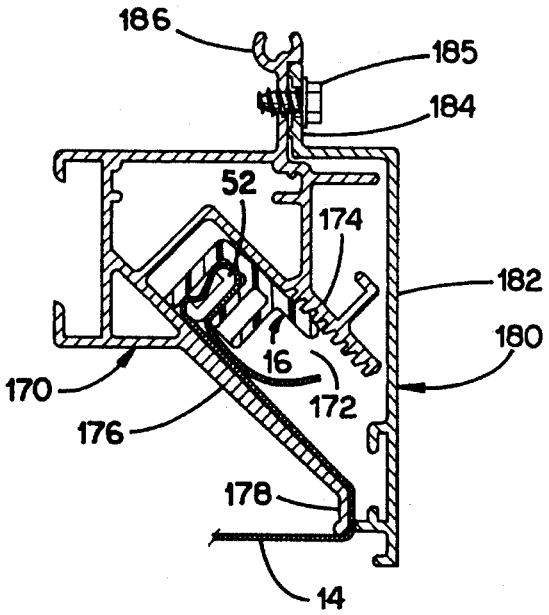
FIG. 9 is similar to FIG. 2 but illustrating an alternate embodiment of a frame member according to the invention.

FIG. 9 shows an alternate embodiment of a peripheral frame member 170 in which the tension clip receiving recess 172 with an exterior opening oriented generally forwardly and outwardly. The recess is of a configuration and function similar to that described above, having a grooved outer wall 174, an inwardly and forwardly spaced apart inner wall 176, and a forwardly extending lip 178 which serves to bend and guide the margin of the fabric into the recess. The grasping of the margin of the fabric by the tension clip 16 and spline 52 is as described above, as is also the cooperative ratcheting engagement of the tension clip teeth with the grooves under the influence of the tension in the fabric.

It should be understood that other orientations of the frame recess are possible within the scope of the present invention. The recess may open toward the opening, outwardly, or even rearwardly.

In the embodiment of FIG. 9, the fabric 14 itself covers the frame from view from the front, and the amount of viewable area of the fabric is increased. A cover member 180 may be provided, generally in the form of a strip having an outer wall 182 which covers the outer side of the frame. The cover member has a rear, inwardly offset flange 184 which is attached by a screw 185 to rear flange 186 of the frame member in a manner similar to that described above with respect to FIG. 10 and cover member 18.

The above description is that of preferred embodiments of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A tensioned fabric sign comprising:

a peripheral frame defining an opening disposed inwardly of the peripheral frame, said peripheral frame formed with a first wall and a second wall spaced apart from said first wall and forming a longitudinal frame recess therebetween, said first wall having a plurality of spaced, longitudinal grooves formed thereon and disposed within said frame recess;

a sheet of flexible sign fabric disposed in a tension generally over said opening and having a fabric margin disposed generally adjacent said peripheral frame; and at least one tension clip formed as a stiff clip body having a width less than the width of said frame recess, said stiff clip body having a longitudinal tension clip recess opening toward said second wall, said clip body further having means for engagement with at least some of said grooves upon rotation of said clip body within said frame recess, said tension clip being inserted into said frame recess with a portion of said fabric margin passing into said frame recess between said second wall and said clip body, said fabric margin further passing away from said second wall into said tension clip recess and grasped within said tension clip recess, whereby the tension of the sign fabric tends to rotate said tension clip within said frame recess and urge said means for engagement into engagement with said grooves.

2. The tensioned fabric sign of claim 1 further comprising a spline, and wherein said portion of the fabric margin is wrapped around said spline, both said portion of the fabric margin and said spline being grasped within said tension clip recess.

3. The tensioned fabric sign of claim 2 wherein tension developed in said fabric causes said portion of the fabric margin to be pinched between said spline and said tension clip body.

4. The tensioned fabric sign of claim 2 further comprising detent means on said tension clip disposed in said tension clip recess for engaging said portion of the fabric margin and said spline.

5. The tensioned fabric sign of claim 4 wherein said spline is formed with a trough, and wherein said detent means engage said trough.

6. The tensioned fabric sign of claim 1 wherein said means for engagement comprises a plurality of longitudinal teeth.

7. The tensioned fabric sign of claim 6 wherein said grooves and said teeth are configured as a ratchet so that said tension clip may be inserted into the frame recess and retained therein at an appropriate depth of insertion to develop a desired degree of fabric tension.

8. The tensioned fabric sign of claim 1 wherein said frame recess opens forwardly.

9. The tensioned fabric sign of claim 1 wherein said frame recess opens at an angle forwardly and outwardly.

10. The tensioned fabric sign of claim 1 further comprising a plurality of cover members attached to said peripheral frame and covering said fabric margin and said frame recess from view.

11. The tensioned fabric sign of claim 1 further comprising an intermediate frame member extending between two opposed portions of said peripheral frame thereby dividing said opening into two openings, each of said openings having an associated sheet of sign fabric with a fabric margin disposed adjacent said intermediate frame member, said intermediate frame member having two longitudinal recesses disposed adjacent each of said two openings, each of said fabric margins disposed adjacent said intermediate frame member and being grasped by a tension clip, said tension clip being inserted in said adjacent recess and retained therein in tensioning engagement.

12. The tensioned fabric sign of claim 1 further comprising a depression formed in said clip body and adapted for engagement with a pry tool for removal or loosening of said tension clip.

13. A tensioned fabric sign comprising:

a peripheral frame including a plurality of elongated frame members joined in end-to-end relationship and defining an opening disposed inwardly of the frame, each of said frame members including a longitudinal first wall, a longitudinal second wall spaced a distance from said first wall, a longitudinal frame recess formed between said first and second walls, said frame recess having an outwardly directed opening, said second wall formed with a plurality of longitudinal, closely spaced grooves;

at least one sheet of flexible, indicia-bearing fabric disposed generally overlying said opening and having a fabric margin disposed generally adjacent said frame recess; and a plurality of tension clips disposed at intervals along said fabric margin and said peripheral frame inserted into said frame recess, each of said tension clips including:

a stiff clip body dimensioned for insertion into said frame recess, said clip body having a width less than said distance between said first and second frame walls, whereby said clip body can rotate within said frame recess, a longitudinal clip recess formed in said clip body and opening toward said first wall, means for grasping a portion of said fabric margin within said clip recess, and longitudinal tooth means along clip body disposed outwardly of said clip recess and directed toward said grooves and adapted for retaining engagement with said grooves;

wherein said fabric margin extends into said frame recess between said first wall and said clip body and into grasping engagement with said clip recess, and wherein tension developed in said fabric tends to rotate said tension clip and urge said tooth means into engagement with said grooves.

14. The tensioned fabric sign of claim 13 wherein said tooth means and said grooves are configured for ratcheting engagement therebetween such that said tension clip may be pressed more deeply into said recess but not withdrawn.

15. The tensioned fabric sign of claim 13 further comprising a depression formed in the extent of said clip body adjacent said tooth means adapted for engagement with a pry tool for disengaging said toothness from said grooves.

16. The tensioned fabric sign of claim 13 wherein said clip recess is defined by a lip extending into said frame recess and toward said first wall.

17. The tensioned fabric sign of claim 16 wherein portions of said lip are formed with detents extending into said clip recess.

18. The tensioned fabric sign of claim 13 further comprising at least one intermediate frame member extending between opposed peripheral frame members and dividing said opening into two openings, a sheet of sign fabric overlying each of said openings and having fabric margins disposed along said intermediate frame member, said intermediate frame member formed with a pair of recesses, each of said recesses having a fabric margin portion and tension clips inserted therein in tensioning engagement therewith.

19. A tensioned fabric sign comprising:

a peripheral frame including a plurality of elongated frame members joined in end-to-end relationship and defining an opening disposed inwardly of the frame, each of said frame members including a longitudinal first wall, a longitudinal second wall spaced apart from said first wall, a longitudinal frame recess formed between said first and second walls, said recess having an opening, said second wall formed with a plurality of longitudinal, closely spaced grooves;

at least one sheet of flexible, indicia-bearing fabric disposed generally overlying said opening and having a fabric margin disposed generally adjacent said frame recess;

a plurality of tension clips disposed at intervals along said fabric margin and said peripheral frame inserted into said frame recess, each of said tension clips including:

a clip body dimensioned for insertion into said frame recess, said clip body having an outer extent toward said opening and an inner extent away from said opening, a clip recess formed along the inner extent of said clip body and opening toward said first wall, said clip recess defined by a lip extending toward said first wall, wherein portions of said lip are formed with detents extending into said clip recess, longitudinal tooth means along the outer extent of said clip body directed toward said grooves and adapted for retaining engagement with said grooves;

a spline having a trough disposed toward said detents, said fabric margin portion being wrapped around said spline, and said spline and said fabric margin being inserted into said clip recess with said detents forcing said fabric margin into said trough; and wherein said fabric margin extends into said frame recess between said first wall and said clip body and into grasping engagement with said clip recess, and wherein tension developed in said fabric tends to rotate said tension clip and urge said teeth into engagement with said grooves.

20. A tensioned fabric sign comprising:

a peripheral frame including a plurality of elongated frame members joined in end-to-end relationship and defining an opening disposed inwardly of the frame, each of said frame members including a longitudinal first wall, a longitudinal second wall spaced apart from said first wall, a longitudinal frame recess formed between said first and second walls, said frame recess having an outwardly directed opening, said second wall formed with a plurality of longitudinal, closely spaced grooves;

at least one sheet of flexible, indicia-bearing fabric disposed generally overlying said opening and having a fabric margin disposed generally adjacent said frame recess;

a plurality of tension clips disposed at intervals along said fabric margin and said peripheral frame inserted into said frame recess, each of said tension clips including:

a clip body dimensioned for insertion into said frame recess, a lip extending from said clip body into said frame recess and toward said first wall, said lip defining a clip recess opening toward said first wall, portions of said lip formed with detents extending into said clip recess, and longitudinal tooth means disposed outwardly of said clip recess and directed toward said grooves and adapted for retaining engagement with said grooves; and a spline having a trough disposed toward said detents, said fabric margin extending into said frame recess between said first wall and said clip body and wrapped around said spline, said spline and said fabric margin portion being inserted into said clip recess in grasping engagement with said clip recess, said detents within said trough;

wherein tension developed in said fabric tends to rotate said tension clip and urge said tooth means into engagement with said grooves.

21. A tensioned fabric sign comprising:

a frame defining a frame channel having first and second walls spaced apart a distance from one another, said first wall having a plurality of spaced, longitudinal grooves formed thereon;

a sheet of flexible sign fabric disposed in tension on said frame and having a margin portion located within said frame channel; and a plurality of tension clips each comprising a relatively stiff clip body having a width less than said distance between said first and second channel walls whereby said clip can rotate within said channel, said clip having first and second sides generally facing said first and second channel walls, respectively, said clip having securing means for securing said fabric margin portion to said clip, said fabric extending between said second clip side and said second channel wall, said first clip side having engagement means for engaging said grooves upon rotation of said clip within said channel, whereby the tension of said sign fabric on said clips rotates said clips within said frame channel and urges said engagement means into engagement with said grooves.

22. A tensioned fabric sign as defined in claim 21 wherein said securing means comprises:

said clip body defining a recess, said fabric margin portion located within said clip recess; and retaining means for retaining said fabric margin portion within said clip recess.

23. A tensioned fabric sign as defined in claim 22 wherein said retaining means comprises a spline within said clip recess, said fabric margin portion being wrapped around said spline.

24. A tensioned fabric sign as defined in claim 22 wherein said clip recess opens through said second side of said clip body towards said second channel wall.

25. A tensioned fabric sign as defined in claim 21 wherein said engagement means comprises teeth on said clip body.

26. A tensioned fabric sign as defined in claim 21 wherein said channel grooves and said clip engagement means are configured as a ratchet so that said tension clip may be inserted into said frame channel and retained therein at an appropriate depth of insertion to develop a desired degree of fabric tension.

* * * * *

UNITED STATES PATENT AND TRADEMARK OFFICE

CERTIFICATE OF CORRECTION

PATENT NO. : 5,467,546

DATED : November 21, 1995

INVENTOR(S) : Kovalak, Jr.

It is certified that error appears in the above-indentified patent and that said Letters Patent is hereby corrected as shown below:

Column 9, Claim 13, Line 20:
after "spaced" insert --apart--

Column 9, Claim 13, Line 42:
after "along" insert --said--

Signed and Sealed this

Twelfth Day of March, 1996

Bruce Lehman

*Attest:*

BRUCE LEHMAN

*Attesting Officer*

*Commissioner of Patents and Trademarks*

US005467546C1

(12) REEXAMINATION CERTIFICATE (4817th)

United States Patent

Kovalak, Jr.

(10) Number: US 5,467,546 C1

(45) Certificate Issued: Jul. 22, 2003

(54) TENSIONED FABRIC SIGN

(75) Inventor: Judson L. Kovalak, Jr., Rockford, MI (US)

(73) Assignee: Breihof Ventures, LLC, Grand Rapids, MI (US)

Reexamination Request:
No. 90/006,037, Jun. 15, 2001

Reexamination Certificate for:

| | |
|---|---|
| Patent No.: | **5,467,546** |
| Issued: | **Nov. 21, 1995** |
| Appl. No.: | **08/063,245** |
| Filed: | **May 18, 1993** |

Certificate of Correction issued Mar. 12, 1996.

Related U.S. Application Data

(63) Continuation-in-part of application No. 07/690,055, filed on Apr. 23, 1991, now abandoned.

(51) Int. Cl.[7] ..... G09F 17/00

(52) U.S. Cl. ..... 40/603; 160/378

(58) Field of Search ..... 40/603, 549, 604; 160/378, 328, 392, 395, 380; 38/102.91

(56) References Cited

U.S. PATENT DOCUMENTS

| | | | |
|---|---|---|---|
| 4,937,961 | A | 7/1990 | Gandy et al. |
| 5,046,546 | A | 9/1991 | Benedyk et al. |

OTHER PUBLICATIONS

Imperial Pamphlet, Publication entitled: "General Drawing New Product" dated: Jun. 18, 1988.

*Primary Examiner*—William L. Miller

(57) ABSTRACT

A tensioned fabric sign having a peripheral frame and a sheet of indicia bearing fabric stretched thereon. The margins of the fabric are retained in longitudinal frame recesses by tension clips having teeth in ratcheting engagement with closely spaced grooves formed within the frame recess. The clips are configured with a fabric grasping recess along the extent of the clip innermost of the recess and with teeth along the extent of the clip outermost of the recess. Tension in the fabric tightens the grasp of the clip on the fabric margin and urges the clip teeth into engagement with the frame recess grooves. An intermediate frame member having a pair of recesses for retaining the margins of two sheets of sign fabric is also disclosed.

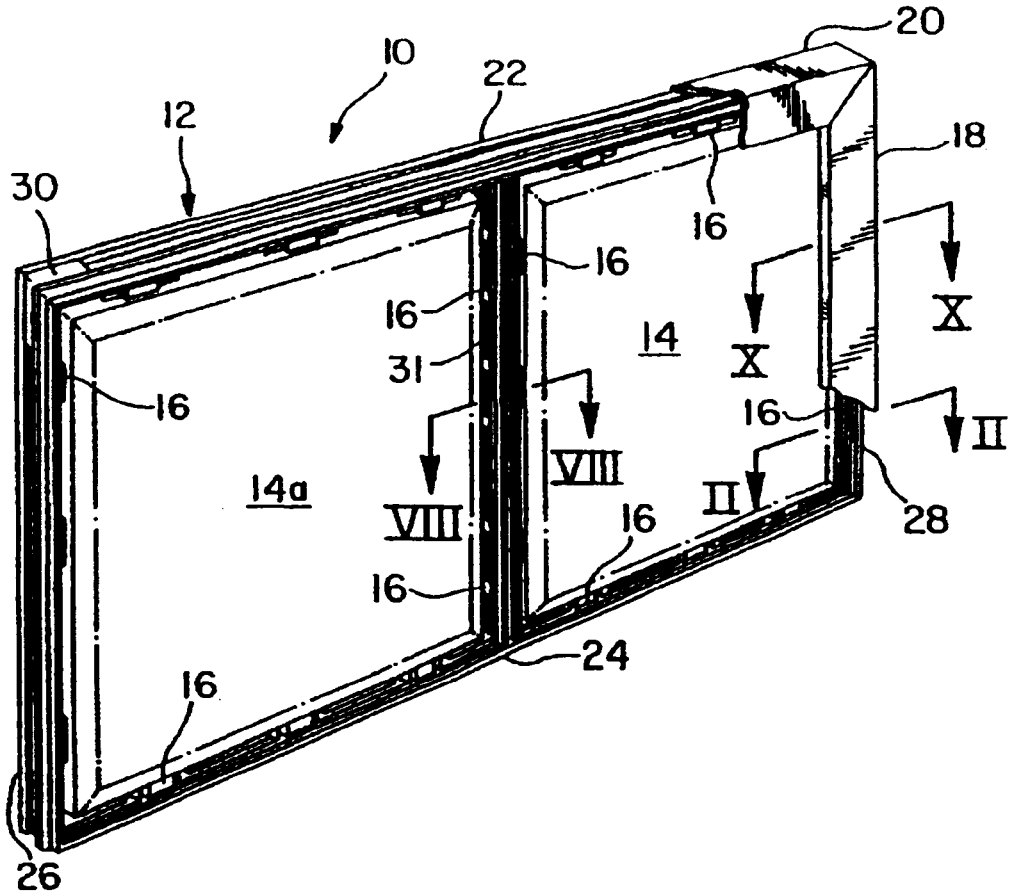

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–26 is confirmed.

* * * * *